US011374338B1

(12) United States Patent
Tseng

(10) Patent No.: US 11,374,338 B1
(45) Date of Patent: Jun. 28, 2022

(54) WIRE CONNECTION DEVICE

(71) Applicant: HEAVY POWER CO., LTD., New Taipei (TW)

(72) Inventor: Chieg-Li Tseng, New Taipei (TW)

(73) Assignee: HEAVY POWER CO., LTD., New Taipei (TW)

( * ) Notice: Subject to any disclaimer, the term of this patent is extended or adjusted under 35 U.S.C. 154(b) by 0 days.

(21) Appl. No.: 17/198,849

(22) Filed: Mar. 11, 2021

(51) Int. Cl.
*H01R 4/64* (2006.01)
*H01R 4/48* (2006.01)
*H01R 9/24* (2006.01)

(52) U.S. Cl.
CPC ..... *H01R 4/4827* (2013.01); *H01R 4/64* (2013.01); *H01R 9/2416* (2013.01)

(58) Field of Classification Search
CPC ..... H01R 4/4827; H01R 4/64; H01R 9/2416
See application file for complete search history.

(56) References Cited

U.S. PATENT DOCUMENTS 10,193,245 B2 * 1/2019 Lorenschat ..... H01R 4/4845
10,498,050 B1 * 12/2019 Liang ..... H01R 4/4836

* cited by examiner

*Primary Examiner* — Vanessa Girardi
(74) *Attorney, Agent, or Firm* — Rabin & Berdo, P.C.

(57) ABSTRACT

A wire connection device includes a housing, a conductor, and a lever. The conductor is located inside the housing and has a leaf spring, a conductive member and a push-back block, and the lever is provided with a push-back notch and an actuating cam, and the lever is movably assembled in the housing so that the lever may swing against the housing so that the leaf spring is squeezed by the lever for generating a deformation. When the lever swings to an actuate position, the touch surface of the cam that touch the conductor will be changed so that the lever can be moved in a straight line against the housing simultaneously. Therefore, the push-back block can be inserted into the inside of the push-back notch. In this way, when the push-back block is positioned inside the push-back notch, the lever is kept stay so that the leaf spring is kept in a state of deformation by the lever, and the wire can insert into the wire connection device without push the leaf spring, so that the wire connection device won't be damaged easily.

14 Claims, 15 Drawing Sheets

WIRE CONNECTION DEVICE

FIELD OF THE INVENTION

The present invention relates to a wire connection device for electrically connecting an electric product to an external power source, and in particular to a wire connection device that prevents damage when a wire is inserted.

BACKGROUND OF THE INVENTION

In general, a wire connection device is used to electrically connect an electric product to an external power source so that the electric product can be temporarily or permanently electrically connected to the external power source through the electrical connection device.

The basic structure of a common wire connection device today is formed with a housing and a conductor. The housing is hollow and has an insertion hole communicated to the inside of the housing; the conductor is positioned inside the housing and is on one side of the insertion hole. In this way, when a wire is inserted into the interior of the housing through the insertion hole, the wire is pressed against the conductor so that the conductor can be deformed and clamped to the wire.

However, when the conductor is deformed by the wire extrusion, the conductor generates an elastic force on the wire, and when the wire penetrates into the inside of the housing through the insertion hole, the wire is easily misaligned in the conductor due to the elastic force and thus cannot be clamped by the conductor; thereby, the wire must be repeatedly inserted into the inside of the housing so that the structure pattern of the conductor will generate the elastic force due to repeated plugging and unplugging, resulting in the conductor becoming elastically fatigued and unable to clamp the conductor to the wire, therefore, the conductor becoming unusable and relatively shortening the service life of the wire connection device.

In particular, in order to extend the service life of the wire connection device, the wire connection device is additionally provided with a lever. The lever is movably assembled in the housing so that the lever can swing against the housing to squeeze on the conductor. In this way, before the wire is inserted into the inside of the housing through the insertion hole, the lever swings against the housing so that the conductor can be deformed by the swinging lever, and the wire can be clamped by the conductor when it is inserted into the housing. However, when the conductor is deformed, the elastic force acts on the lever at the same time so that the lever moves back to an initial position that is not squeezed on the conductor by the elastic force. In order to prevent the lever from moving to the above initial position before the wire is inserted into the housing, a user must keep pushing against the lever to stop the lever from moving so that the lever may keep squeezing on the conductor. Otherwise, once the user releases his or her hand, the conductor will move the lever back to the initial position through the elastic force, resulting in inconvenience when the wire is inserted inside the housing.

SUMMARY OF THE INVENTION

The main purpose of the invention is to communicate the lever and the housing in a way that the lever can move in a straight line relative to the housing while the lever is swinging relative to the housing.

The secondary purpose of the invention is to improve the structural forms of both the conductor and the lever so that when the conductor is squeezed by the lever and deformed, the lever can not move against the housing, and the conductor holds the deformed state so that wires are not squeezed on the conductor when they are threaded into the wire connection device, thereby making the wires to be actually clamped by the conductor, which reduces the chance of damage to the wire connection device.

To achieve the aforementioned purpose, the invention is a wire connection device comprising a housing, a conductor and a plurality of levers. In this embodiment, the housing has a plurality of insertion holes, and an accommodation space that is formed inside the housing for communicating with the insertion holes so that a plurality of wires can penetrate into the accommodation space through the insertion holes. However, the conductor is located inside the accommodation space and has a leaf spring capable of deformation and a conductive member capable of conducting the plurality of conductors to each other. The conductive steel sheet has a carrier portion connected to the conductive member and a wire clamping portion formed by extending from the carrier portion. A push-back block is formed by extending one of the conductive member and the carrier portion. The wire clamping portion may contact the wire against the conductive member. In addition, several levers are movably assembled in the housing. A push-back notch that matches the push-back block and an actuating cam that is accessible to the conductor are formed on the lever inside the housing. The lever swings from an initial position to an actuate position. The position of an actuating cam surface that contacts the surface of the conductor will be changed so that the lever moves relatively with the housing at the same time.

When the lever is positioned in the actuate position, the wire clamping portion is deformed through the squeezing by the lever, and the push-back block is inserted into the push-back notch.

In this embodiment, the actuating cam is provided with an activation surface close to the push-back notch and a fixed surface away from the activation surface in different localized areas. The activation surface and the fixed surface are located on opposite sides of the actuating cam. When both the activation surface and the fixed surface are in contact with the conductor, the lever stays in the activation position. The lever swings from the actuate position to the initial position, the lever is not pressed against the leaf spring so that the activation surface faces the push-back block and the push-back block is positioned outside the push-back notch, and meanwhile the fixed surface is not separated from the conductor.

In addition, the actuating cam further has an initial positioning surface between the activation surface and the fixed surface and has a first push-back surface adjacent to one side of the initial positioning surface. The initial positioning surface contacts the conductor to allow the lever to hold in the initial position. The first push-back surface is close to the push-back notch. In the process of moving the lever to the actuate position, the first push-back surface pushes against the push-back block, causing the push-back block to be deformed. The initial positioning surface has a second push-back surface adjacent to the activation surface on a side distant from the first push-back surface. When the first push-back surface is pushed against the push-back block, the second push-back surface is in contact with the conductor, and the activation surface and the initial positioning surface are separated from the conductor.

In addition, when the push-back block is inserted into the interior of the push-back notch, at least two surfaces of the push-back notch are in contact with the push-back block at the same time. In a preferred embodiment, the push-back notch has a first push-back surface close to the actuating cam and a second push-back surface away from the actuating cam. A push-back end surface is formed between the first push-back surface and the second push-back surface. When the push-back block is located inside the push-back notch, both the first push-back surface and the push-back end surface are in contact with different sides of the push-back block. A separation distance is formed between the first push-back surface and the second push-back surface. The length of the separating distance is greater than the thickness of the push-back block. Further, the second push-back surface is separating from the push-back block when both of the first push-back surface and the push-back end surface are in contact with different sides of the push-back block.

Further, the push-back notch is provided with a push-back opening away from the push-back end face, and the second push-back surface will gradually approach the first push-back surface from the push-back opening toward the push-back end surface so that the second push-back surface is tilted to the first push-back surface, and further the push-back notch gradually tapers off from the snap opening toward the push-back end surface.

The lever comprises a connecting arm that provided with the push-back notch and the actuating cam, and a toggle plate formed on the connecting arm. The connecting arm is provided with a stopper. The stopper is provided with a stopping surface on the side away from the connecting arm. The stopping surface may contact the housing when the lever is moved to the actuate position.

In addition, the stopping surface is positioned on the side of the push-back notch away from the actuating cam so that the push-back notch is located between the stopping surface and the actuating cam. A guiding surface away from the insertion hole and a push-back surface adjacent to the guiding surface are formed in the interior of the housing. The stopper is further provided with the push-back surface adjacent to the stopping surface. The push-back surface is in contact with the guiding surface. The stopping surface is in contact with the push-back surface.

Finally, one side of the wire clamping portion is provided with a plurality of windows for the wires to pass through, while the other side of the wire clamping portion is provided with a plurality of flexible sections that one to one aligned the windows. The flexible section, the window, and the insertion hole are aligned each other to form a first straight line. The push-back block is positioned between two of the flexible sections so that the push-back block and two of the flexible sections are aligned to form a second straight line perpendicular to the first straight line.

This invention is characterized by the fact that the lever is equipped with an actuating cam, which allows the lever to swing to the actuate position relative to the housing, and the actuating cam may also change the position of the area in contact with the conductor so that the lever may be moved in a straight line relative to the housing at the same time. In addition, the conductor has the push-back block and the lever has the push-back notch for the lever to be in the actuate position. The lever not only squeezes into the wire clamping portion, but the push-back block penetrates into the push-back notch, allowing the lever to hold in the actuate position. In this way, when the wire clamping portion of the conductor is deformed by squeezing of the lever, the lever remains in the actuate position so that the leaf spring remains in the deformed state. This allows the wire to be penetrated into the wire connection device without squeezing the leaf spring so that both the leaf spring and the conductive member can be clamped to the wire, which relatively reduces the chance of damage to the wire connection device.

DETAILED DESCRIPTION OF THE PREFERRED EMBODIMENTS

Hereinafter, preferred embodiments of the present invention are cited, and further detailed description is given as follows in conjunction with the drawings.

Figure 1:
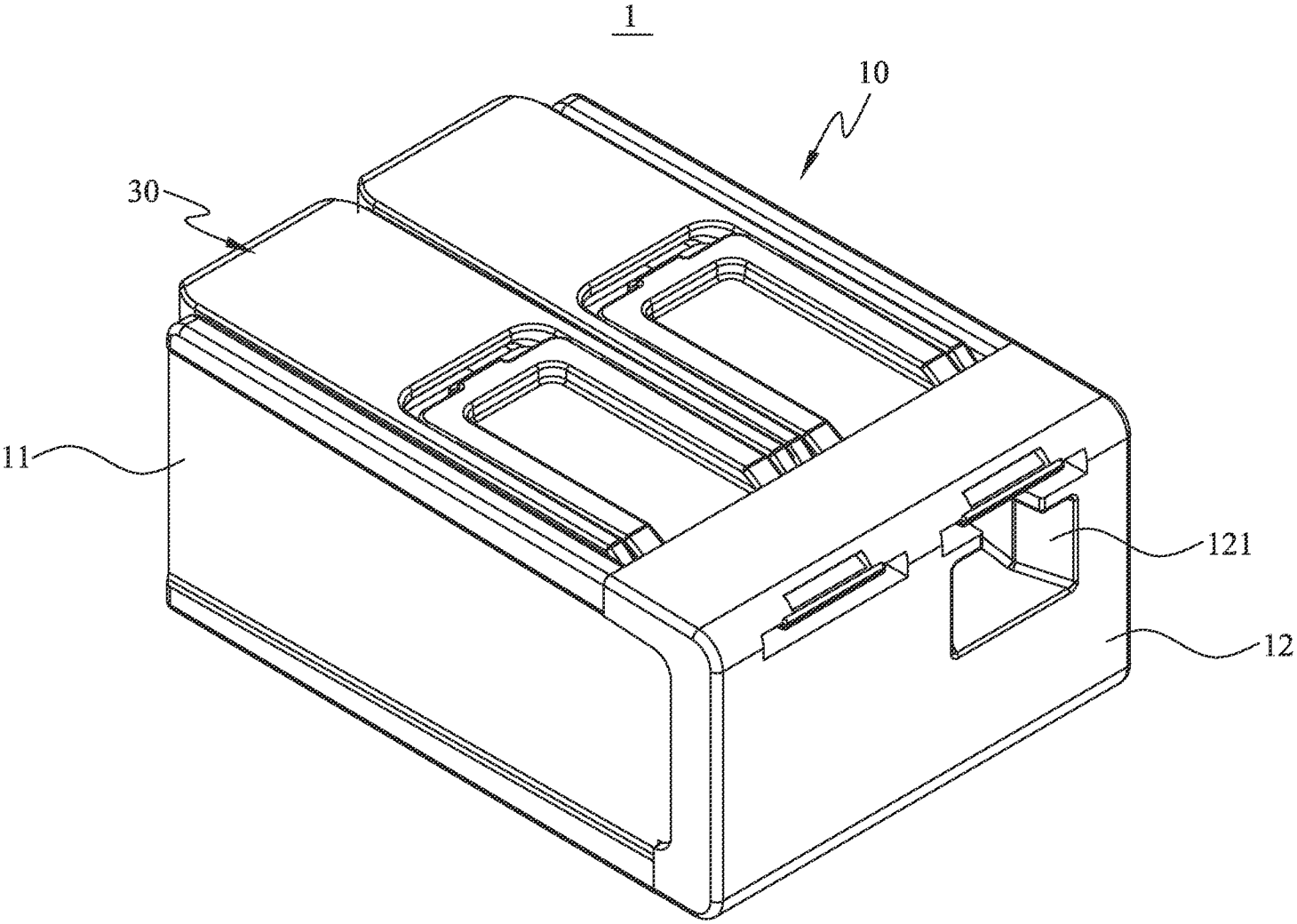
FIG. 1 shows a three-dimensional view of a wire connection device of the invention in a first preferred embodiment.
Figure 2:
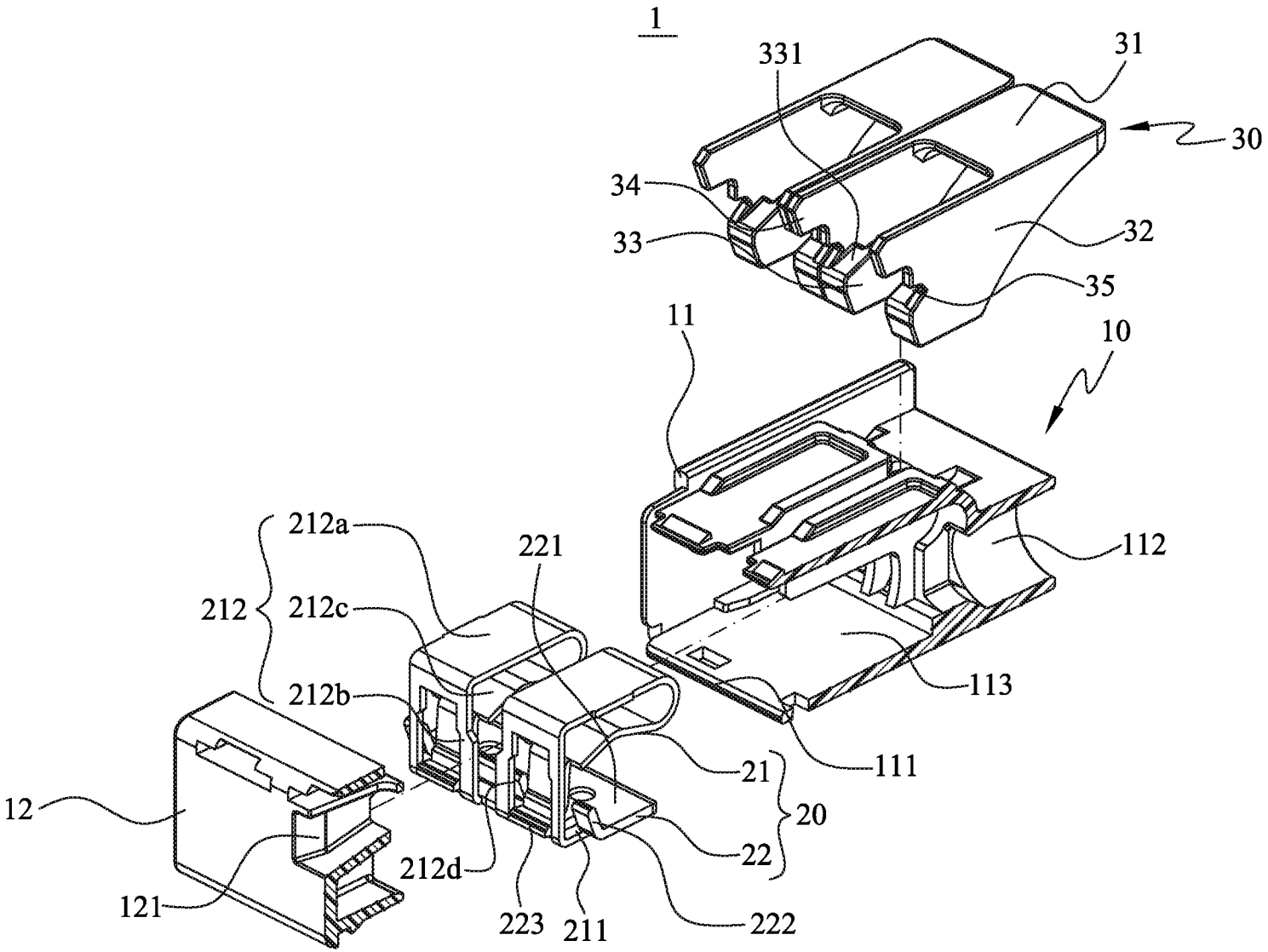
FIG. 2 shows an exploded view of the wire connection device of the invention in the first preferred embodiment.
Figure 3:
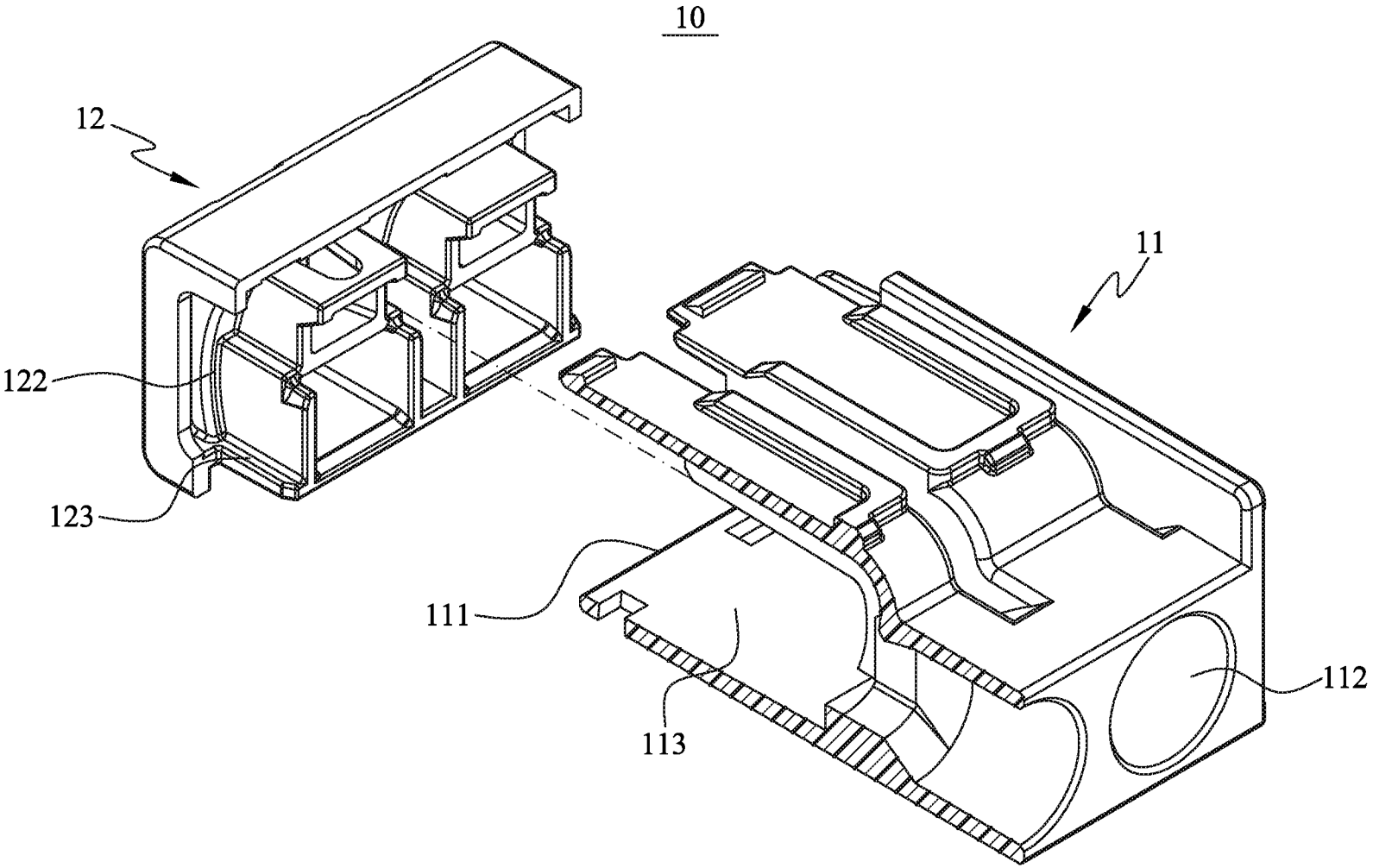
FIG. 3 shows a schematic view of a housing.

With reference to FIGS. 1 to 3, in a first preferred embodiment, a wire connection device 1 of the present invention consists mainly of a housing 10, a conductor 20 and two levers 30. With reference to FIGS. 2 and 3, the housing 10 has a hollow housing 11 in a hollow configuration and a cover 12 attached to the hollow housing 11. As shown in the figure, the hollow housing 11 is provided with a mounting hole 111 on one side near the cover 12, and the hollow housing 11 is provided with two insertion holes 112 of different shapes from the mounting hole 111 on one side away from the mounting hole 111. Furthermore, the hollow housing 11 is internally formed with an accommodation space 113 between the mounting hole 111 and the insertion hole 112 so that the mounting hole 111 is communicated to each of the insertion holes 112 through the accommodation space 113. However, the cover 12 penetrates to form a detection channel 121, wherein the cover 12 has a guiding surface 122 with an arc pattern and a push-back surface 123 with a flat pattern on one side near the hollow housing 11. In this embodiment, the cover 12 is assembled in the mounting hole 111. When the cover 12 is assembled in the mounting hole 111, the cover 12 covers a partial area of the mounting hole 111. The remaining area of the mounting hole 111 is aligned with the detection channel 121 so that the detection channel 121 may be connected to the accommodation space 113, and the guiding surface 122 and the push-back surface 123 are located inside the housing 10. The guiding surface 122 is far away from the insertion hole 112.

Figure 4:
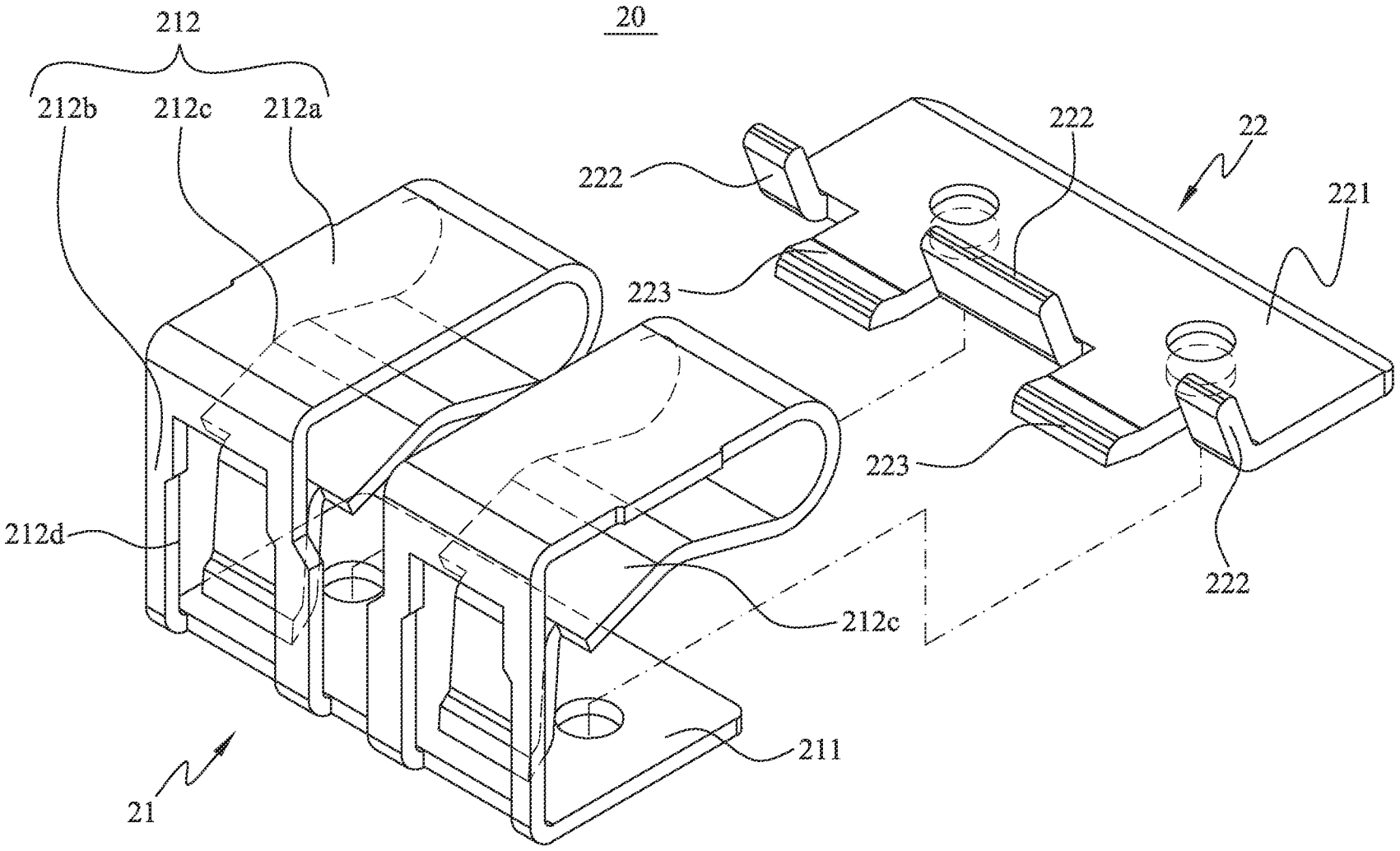
FIG. 4 shows an exploded view of a conductor.
Figure 5:
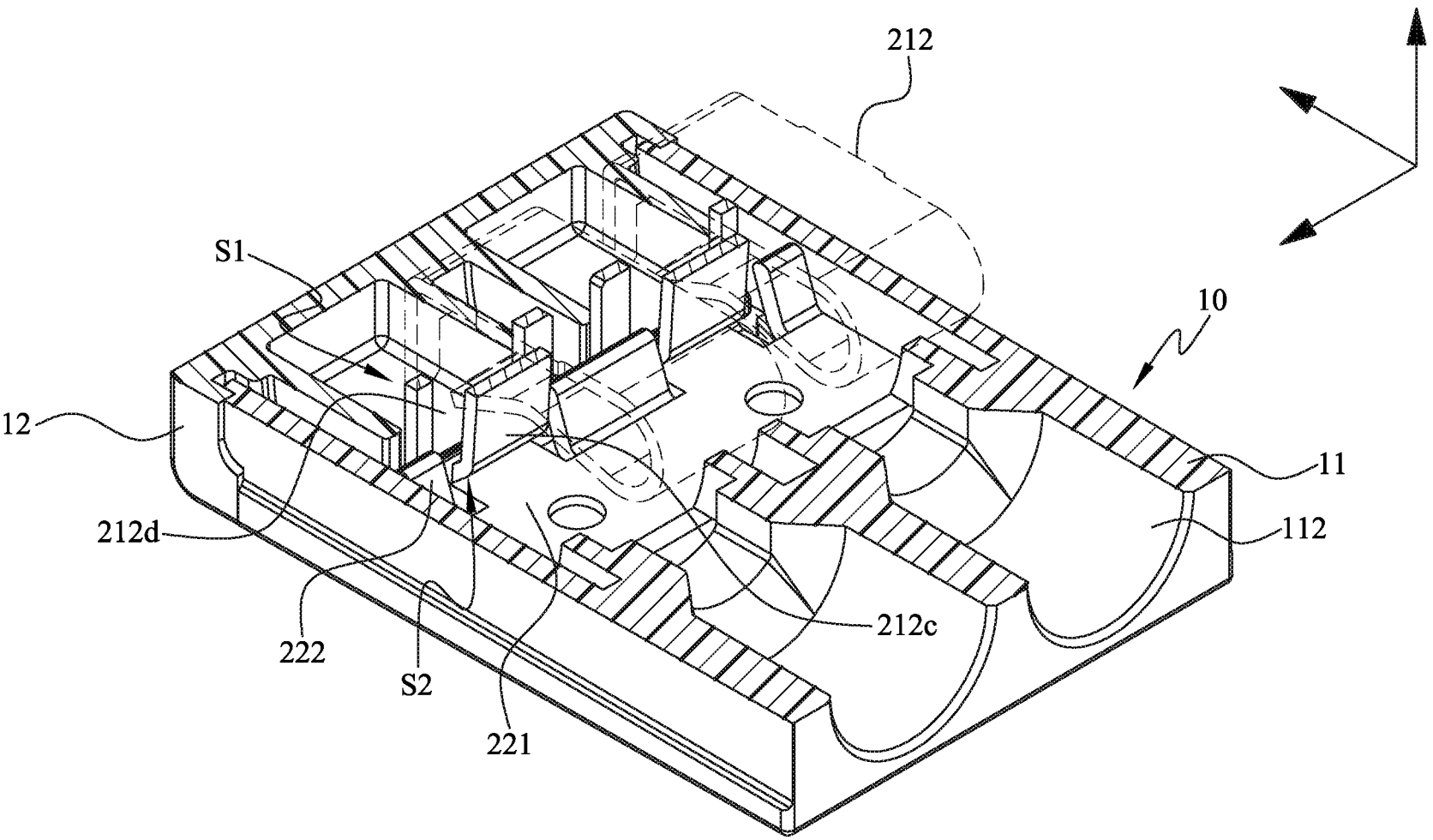
FIG. 5 shows a schematic view of an insertion hole, a window and a flexible section arranged to present a first line pattern.

With reference to FIG. 2 and FIG. 4, the conductor 20 can conduct electricity, and the conductor 20 has two parts: a leaf spring 21 and a conductive member 22. The leaf spring 21 is provided with a carrier plate 211 assembled to the conductive member 22 and two wire clamping portions 212 perpendicular to the carrier plate 211. Each of the wire clamping portions 212 has a connecting section 212*a* parallel to the carrier plate 211 and a support section 212*b* formed on the carrier plate 211. One end of the connecting section 212*a* is formed in the support section 212*b*, and the support section 212*b* is perpendicular to the connecting section 212*a* so that the connecting section 212*a* is spaced apart from the carrier plate 211. Further, the connecting section 212*a* extends away from the support section 212*b* at one end to form a deformable section 212*c*. The support section 212*b* of each of the wire clamping portions 212 penetrates to form a window 212*d*. The flexible section 212*c* of each of the wire clamping portions 212 is positioned between the carrier plate 211 and the connecting section 212*a*. In this embodiment, the flexible section 212*c* is positioned against the window 212*d*, and the flexible section 212*c* contacts the conductive member 22 at one end of the connecting section 212*a* that is remote from the conductive member 22. As shown in the figure, a part of the conductive member 22 is assembled in the carrier plate 211 to provide a contact block 221 in contact with the leaf spring 21. The contact block 221 extends outwardly to form three push-back blocks 222 in an inclined pattern and two guiding blocks 223 in a horizontal pattern, with the three push-back blocks 222 and the two guiding blocks 223 that are interlaced, so that each guiding block 223 is positioned between each of the two push-back blocks 222, where each guiding block 223 is positioned one-to-one through one of the windows 212*d*. In this embodiment, the conductor 20 is positioned inside the accommodation space 113 of the housing 10. When the conductor 20 is located inside the accommodation space 113, one of the wire clamping portions 212 is positioned against the detection channel 121. In this way, a user may check whether the conductive function of the conductor 20 is normal through the detection channel 121; also, each of the wire clamping portions 212 simultaneously pairs up with the insertion hole 112 and the window 212*d* located in the housing 10 so that the insertion hole 112, the window 212*d* and the flexible section 212*c* are in order arranged in a straight line to present a first linear pattern S1 parallel to the X axis (as shown in FIG. 5). In addition, in this embodiment, each flexible section 212*c* is positioned one-to-one above one of the guiding blocks 223 so that each of the flexible sections 212*c* is positioned between each of the two push-back blocks 222, furthermore, a plurality of push-back blocks are aligned with a plurality of flexible sections to form a second vertical pattern S2 perpendicular to the first linear pattern S1 (parallel to the Y-axis).

Figure 6:
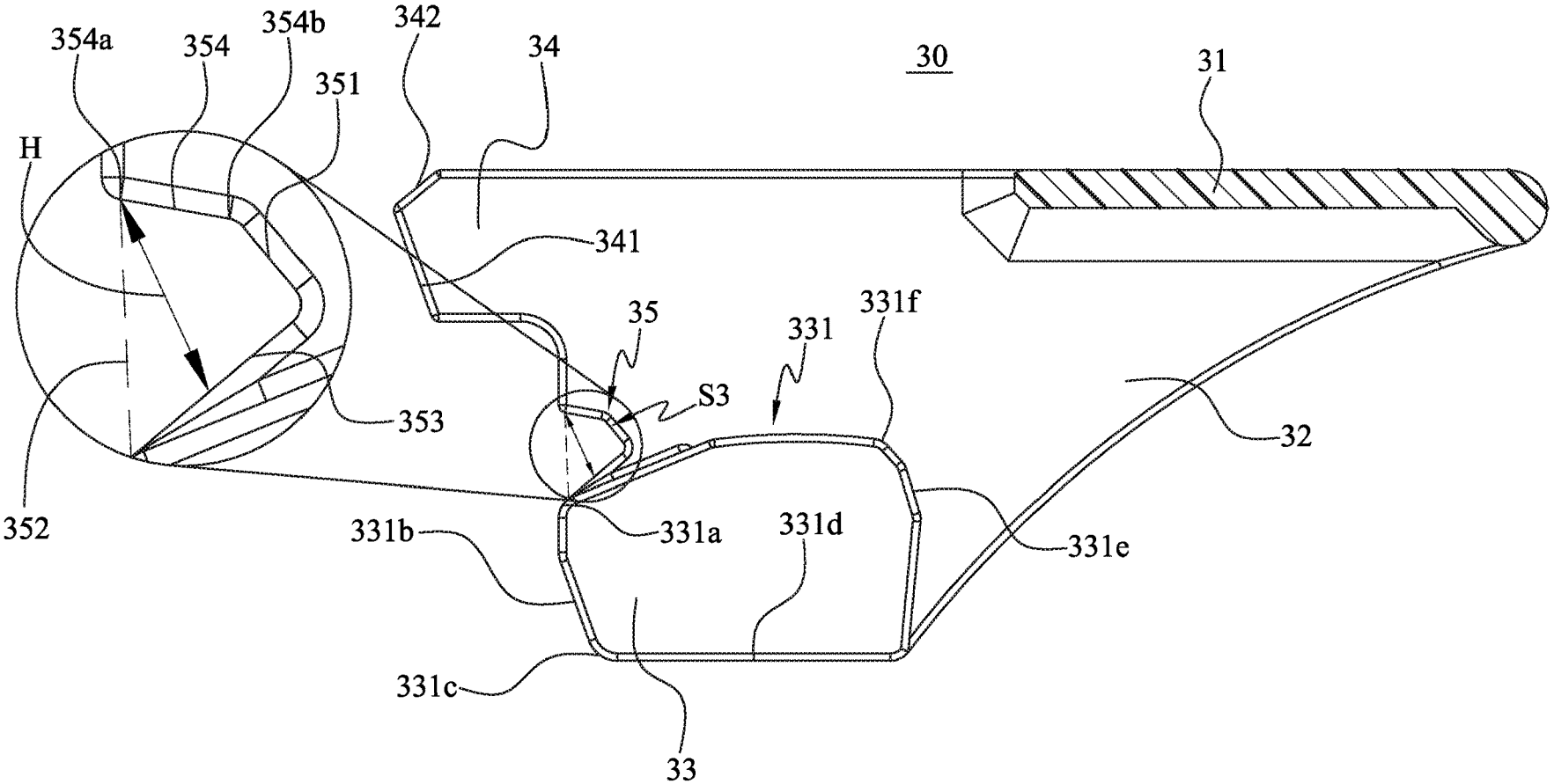
FIG. 6 shows a sectional view of a lever.

With reference to FIG. 2 and FIG. 6, each lever 30 has a toggle plate 31. The toggle plate 31 is formed with a connecting arm 32 on each opposite side, and each connecting arm 32 extends toward the other connecting arm 32 to form an actuating cam 33 between the two connecting arms. Each of the connecting arms 32 is provided with a stopper 34 near the toggle plate 31 and a push-back notch 35 near the actuating cam 33 in the direction from the toggle plate 31 toward the actuating cam 33 in that order. The stopper 34 is spaced in the push-back notch 35. In this embodiment, the stopper 34 is formed by extending outward from the connecting arm 32. The stopper 34 has a flat stopping surface 341 on one side of the remote connecting arm 32 and a push-back surface 342 adjacent to the stopping surface 341. However, the push-back notch 35 is provided with a push-back end 351 on opposite sides and a push-back opening 352 spaced apart on the push-back end 351. A first push-back surface 353 is provided on one side of the push-back end 351 near the actuating cam 33. The push-back end 351 has a second push-back surface 354 on the side away from the first push-back surface 353 and away from the actuating cam 33. The first push-back surface 353 is spaced apart from the second push-back surface 354 so that the first and second snap surfaces 353 and 354 form a spacing H between them, and the length of the spacing H is greater than the thickness of the push-back block 222. In this embodiment, the second push-back surface 354 is provided with a top end 354*a* near the snap opening 352, and the push-back opening 352 is provided with a bottom end 354*b* near the push-back end 351. The top end 354*a* is farther away from the first push-back surface 353 than the bottom end 354*b* so that both the top end 354*a* and the bottom end 354*b* are at different distances from the second push-back surface 354, and the second push-back surface 354 extends from the push-back opening 352 toward the push-back end 351 and gradually approaches the first push-back surface 353, resulting in the second push-back surface 354 being set at an inclined angle to the first push-back surface 353 so that the push-back notch 35 exhibits a gradual shrinking pattern S3 from the push-back opening 352 toward the push-back end 351.

Figure 7:
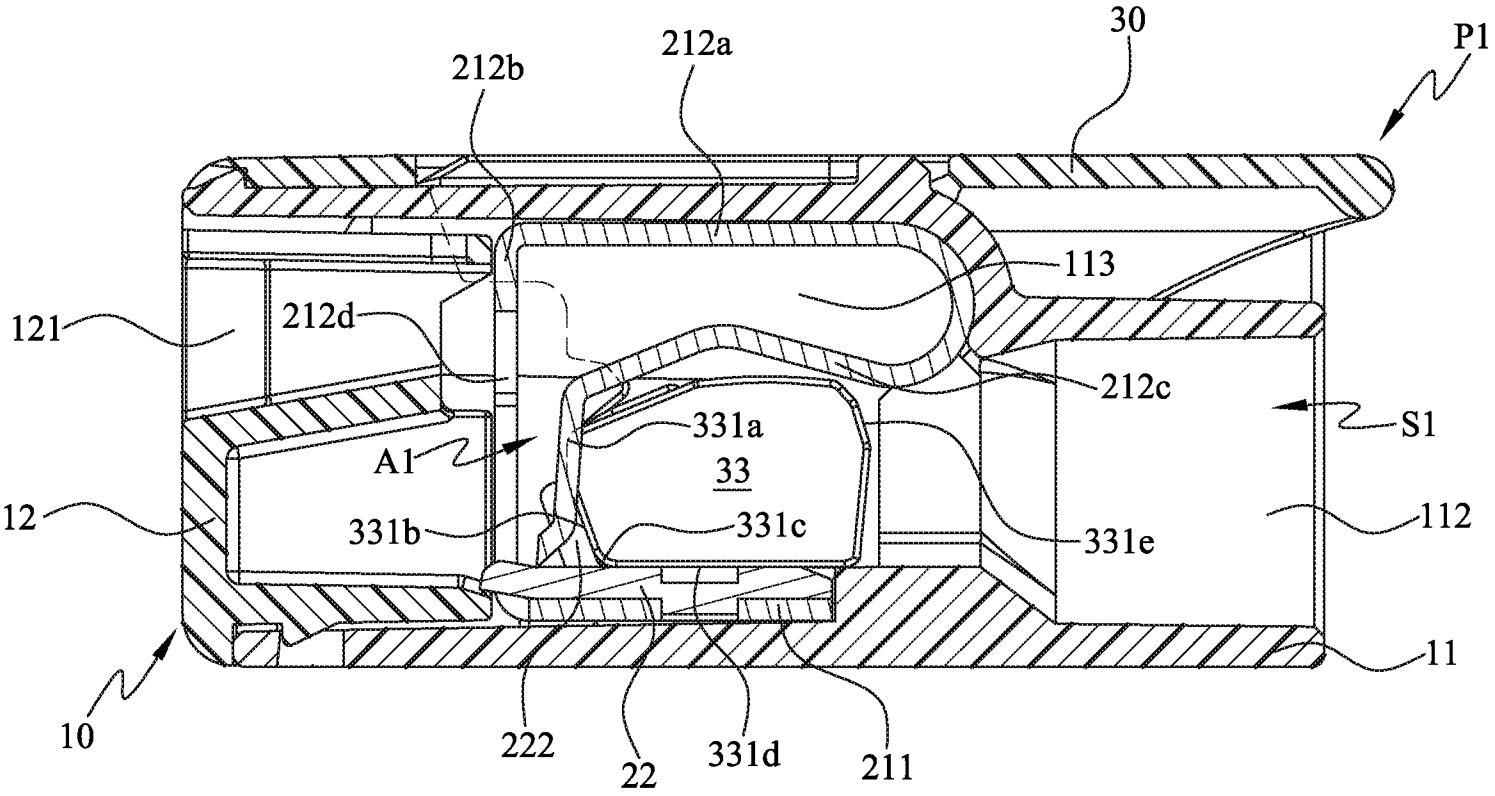
FIG. 7 shows a schematic view of the lever in its initial position.

As shown in FIG. 6, the outer periphery of the actuating cam 33 of the lever 30 is provided with an actuating profile 331. In this embodiment, the actuating profile 331 has a first push-back surface 331*a*, an activation surface 331*b*, a second push-back surface 331*c*, an initial positioning surface 331*d*, a fixed surface 331*e*, and a top support surface 331*f* along the profile of the actuating cam 33. The activation surface 331*b* is located on one side of the actuating cam 33 near the push-back notch 35 of the lever 30, and the opposite sides of the activation surface 331*b* are adjacent to the first and second push-back surfaces 331*a* and 331*c*, respectively. The activation surface 331*b* is flat, and the activation surface 331*b* is located between the push-back notch 35 and the initial positioning surface 331*d*. The initial positioning surface 331*d* is flat as the activation surface 331*b*, and the opposite sides of the initial positioning surface 331*d* are adjacent to the second push-back surface 331*c* and the fixed surface 331*e*, respectively, so that the second push-back surface 331*c* is located between the activation surface 331*b* and the initial positioning surface 331*d*. The initial positioning surface 331*d* intersects the activation surface 331*b* so that the initial positioning surface 331*d* is not parallel to the activation surface 331*b*. In addition, the fixed surface 331*e* is provided on one side of the actuating cam 33 at a distance from the push-back notch 35 so that the activation surface 331*b* and the fixed surface 331*e* are located on opposite sides of the actuating cam 33, respectively, and the initial positioning surface 331*d* is located between the actuating cam 33 and the fixed surface 331*e*. Further, the top support surface 331*f* is provided on the side of the actuating cam 33 that is far from the initial positioning surface 331*d* so that the top support surface 331*f* and the initial positioning surface 331*d* are located on opposite sides of the actuating cam 33, respectively. Also, the top support surface 331*f* is located between the first push-back surface 331*a* and the fixed surface 331*e*. In this embodiment, as shown in FIG. 7, each of the levers 30 is movably assembled in the housing 10 so that the lever 30 and the housing 10 may swing and move relative to each other. When the lever 30 is movably assembled in the housing 10, the toggle plate 31 of the lever 30 is positioned outside the accommodation space 113 of the housing 10, while each of the actuating cams 33 is positioned inside the accommodation space 113. Each of the actuating cams 33 is positioned between the conductive member 22 and the flexible section 212*c* of the leaf spring 21.

With reference to FIG. 7, the initial positioning surface 331*d* of the lever 30 is in contact with the contact block 221 of the conductive member 22. At the same time, the activation surface 331*b* of the lever 30 faces the push-back block 222 of the conductive member 22 so that the lever 30 is in an initial position P1. When the lever 30 is in the initial position P1, the actuating cam 33 of the lever 30 does not touch the flexible section 212*c* of the leaf spring 21 so that the flexible section 212*c* has an initial state A1 without deformation. In this embodiment, when the lever 30 is in the initial position P1, the lever 30 can move laterally in a straight line relative to the housing 10 so that the lever 30 may move either towards the push-back block 222 or towards the insertion hole 112 of the housing 10. When the activation surface 331*b* is in contact with the push-back block 222, the fixed surface 331*e* of the lever 30 is not in contact with the housing 10 and the conductor 20; conversely, when the fixed surface 331*b* is not in contact with the hollow housing 11 of the housing 10, the activation surface 331*b* may be separated from the hollow housing 11.

Figure 8A:
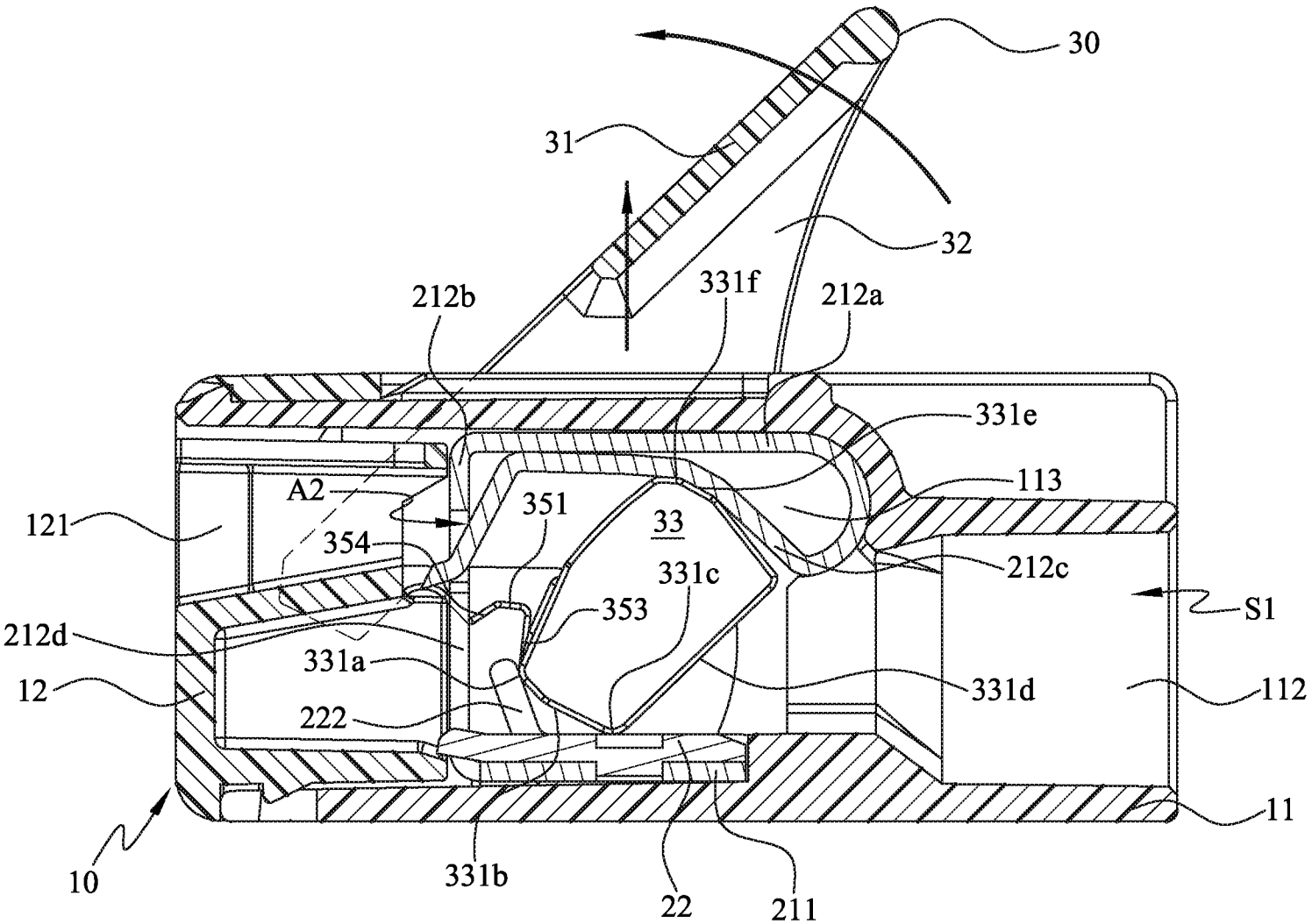
FIG. 8A shows a schematic view of the lever that swings from an initial position to an actuate position.

With reference to FIG. 8A, the lever 30 swings relative to the housing 10 in the direction of the arrow in the figure so that the lever 30 is far from the initial position P1, and the actuating cam 33 swings relative to the hollow housing 11 of the housing 10 so that the first push-back surface of the actuating cam 33 contacts the push-back block 222 of the conductive member 22, thereby making the push-back block 222 to be squeezed by the actuating cam 33 and deformed. At the same time, the second push-back surface 331*c* of the actuating cam 33 contacts the contact block 221 of the conductive member 22, causing the surface of the contact block 221 to change from the initial positioning surface 331*d* to the second push-back surface 331*c* because the actuating cam 33 contacts the contact block 221 and thus causing the actuating profile 331 to change to contact a local area of the conductor 20, thereby the lever 30 also moving in a straight line relative to the housing 10 in the longitudinal direction when the lever 30 swings relative to the hollow housing 11 of the housing 10. As shown in the figure, when the first and second push-back surfaces 331*a* and 331*c* of the actuating cam 33 are in contact with the push-back block 222 and the contact block 221, respectively, the initial positioning surface 331*d* and the fixed surface 331*e* of the actuating profile 331 are not in contact with the conductor 20. In addition, the top support surface 331*f* of the actuating profile 331 contacts the flexible section 212*c* of the wire clamping portion 212 so that the flexible section 212*c* is extruded by the actuating cam 33 and deformed toward the connecting section 212*a* of the wire clamping portion 212, and the flexible section 212*c* is thereby transformed from the initial state A1 to a deformed state A2 where the deformation occurs.

Figure 8B:
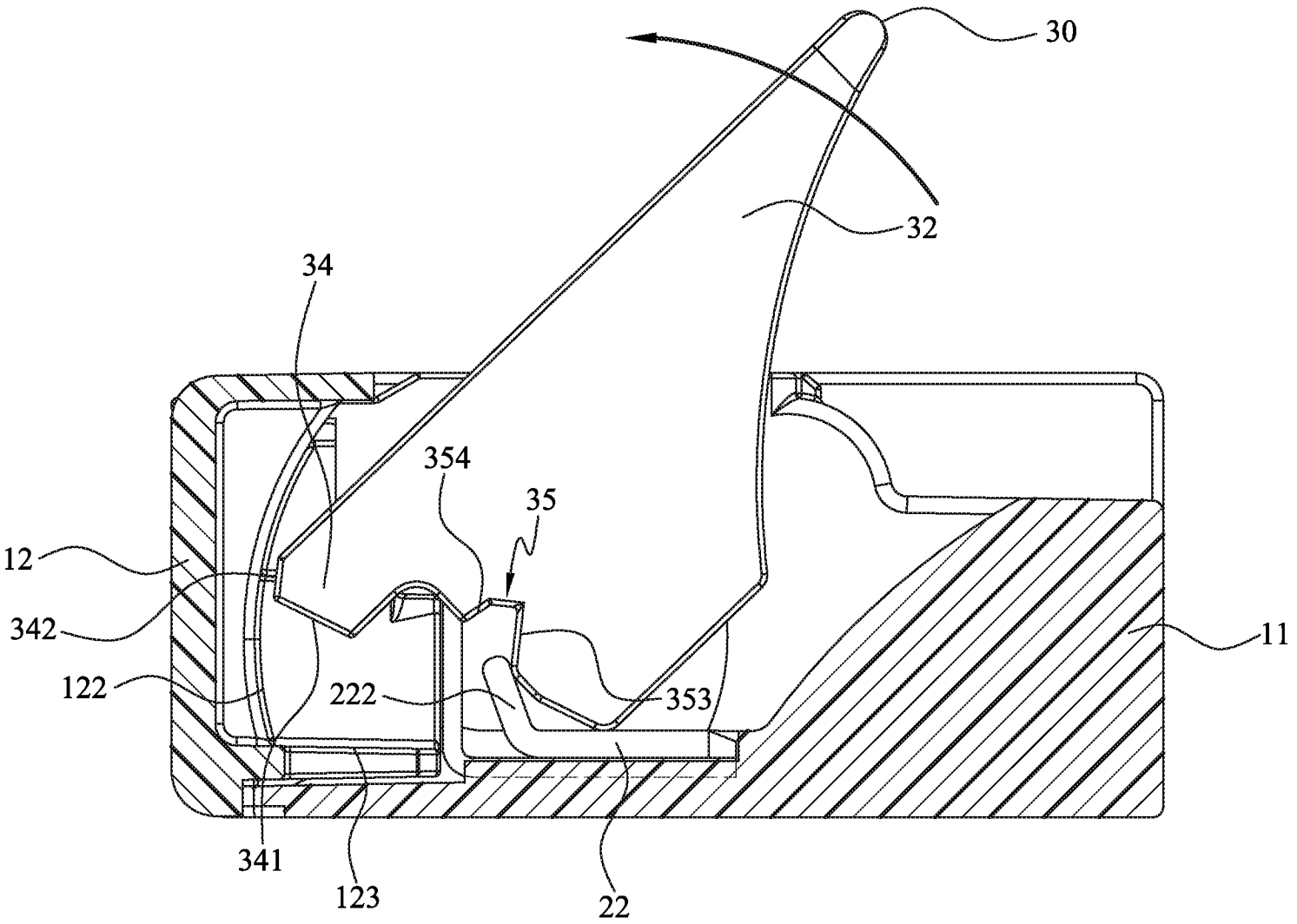
FIG. 8B shows a schematic view of the lever without touching the guiding surface.
Figure 8C:
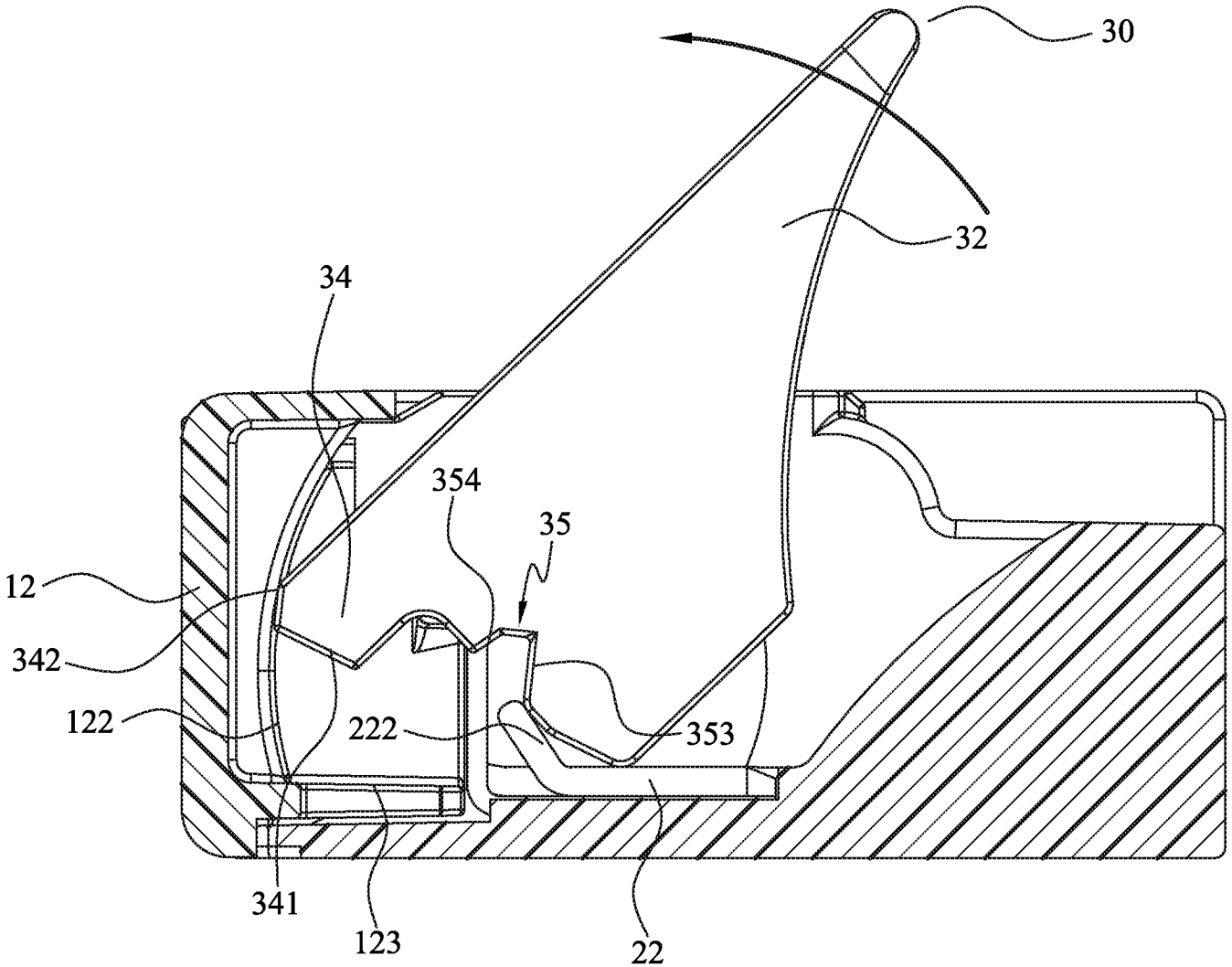
FIG. 8C shows a schematic view of the lever touching the guiding surface.

In this embodiment, as shown in FIG. 8B, in the process of moving the lever 30 away from the initial position P1, the push-back surface 342 of the lever 30 is spaced from the guiding surface 122 of the housing 10 so that the push-back surface 342 does not contact the guiding surface 122. However, the push-back surface 342 does not contact the guiding surface 122 for illustrative purposes only. As also shown in FIG. 8C, during the oscillation of the lever 30 relative to the housing 10, the push-back surface 342 contacts the guiding surface 122 so that the stopping surface 341 of the lever 30 may indeed gradually approach the push-back surface 123 of the housing 10.

Figure 9A:
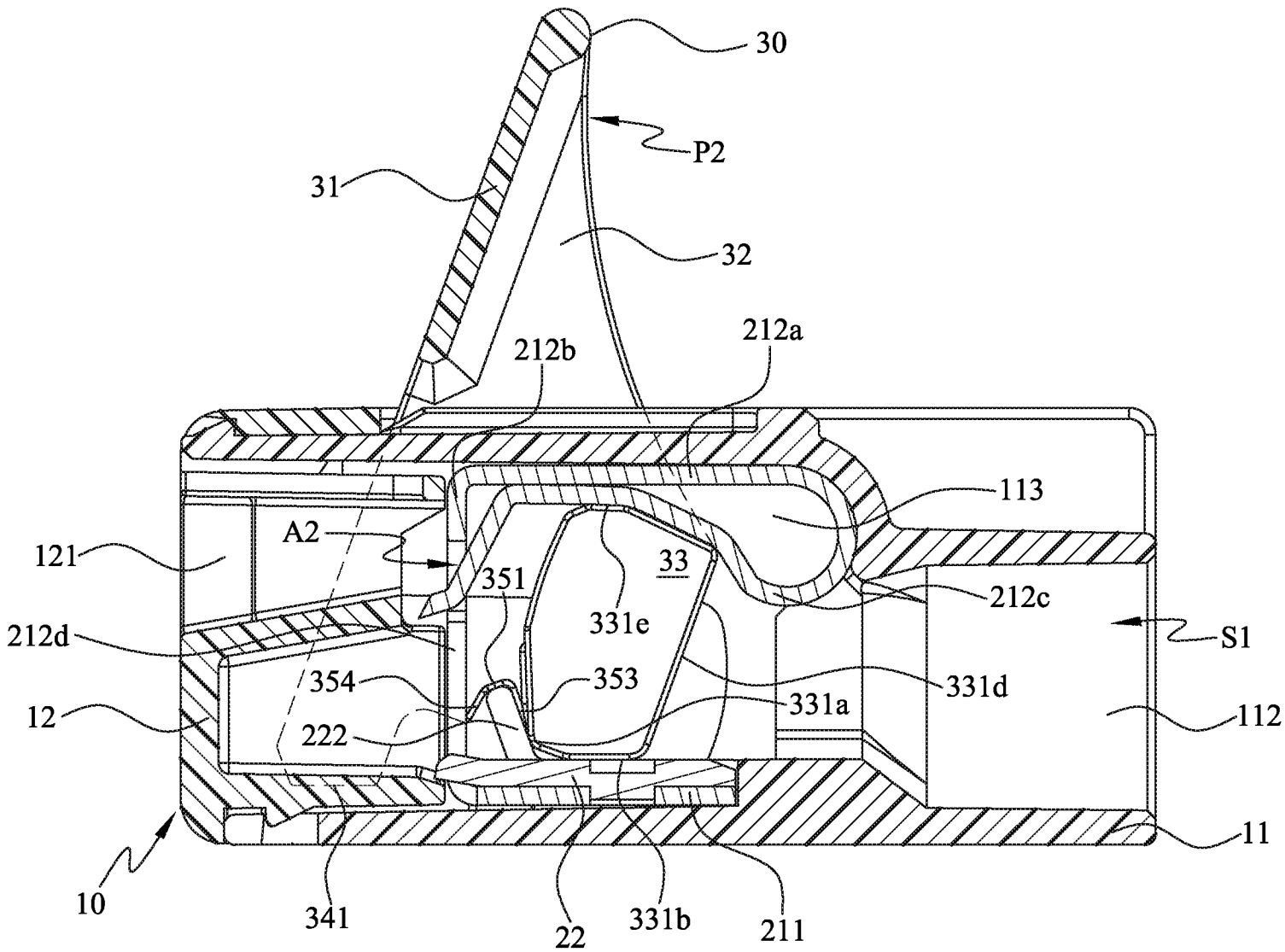
FIG. 9A shows a schematic view of the lever in the actuate position.
Figure 9B:
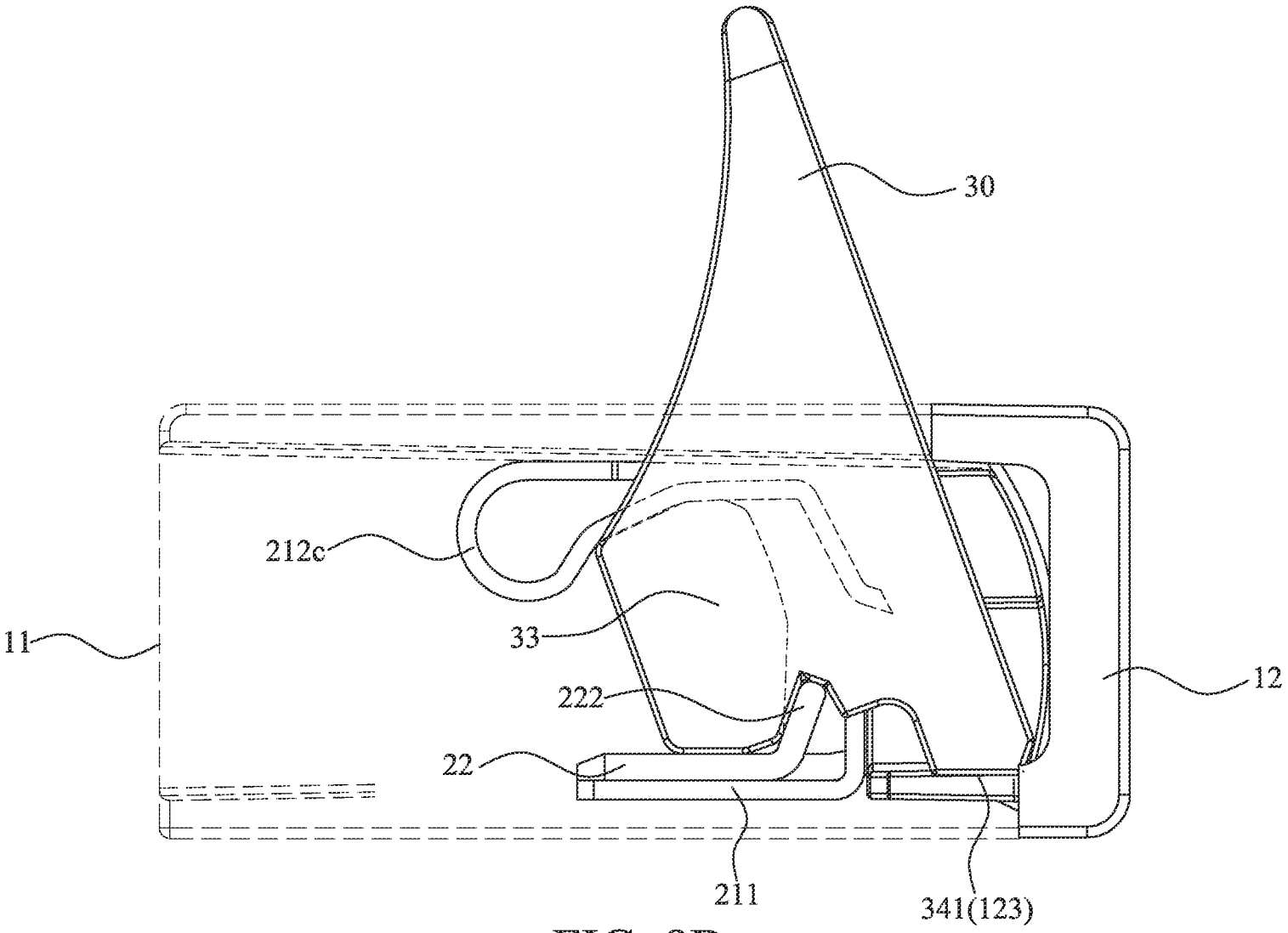
FIG. 9B shows a schematic view of a stopping surface touching a cover.

With reference to FIG. 9A and FIG. 9B, the lever 30 continues to swing against the housing 10 so that the first push-back surface 331*a* of the actuating cam 33 remains close to the contact block 221 of the conductive member 22. At the same time, the actuating cam 33 is continuously pushed against the flexible section 212*c* of the leaf spring 21 so that the flexible section 212*c* is closer to the connecting section 212*a* of the leaf spring 21; thus, the flexible section 212*c* is farther away from the conductive member 22. The lever 30 continues to swing until the stopping surface 341 of the connecting arm 32 contacts the push-back surface 123 of the housing 10, because the push-back notch 35 exhibits a tapering pattern S3, so that the push-back block 222 of the conductive member 22 easily penetrates into the push-back notch 35 of the lever 30. In this embodiment, when the push-back block 222 is positioned inside the push-back notch 35, both the first push-back surface 353 of the push-back notch 35 and the push-back end 351 of the push-back notch 35 are in contact with different sides of the push-back block 222, thus allowing the lever 30 to stop swinging relative to the housing 10. In addition, because the spacing H between the first and second push-back surfaces 353 and 354 is greater than the thickness of the push-back block 222, when the first push-back surface 353 and the push-back end 351 are both in contact with different sides of the push-back block 222, the second push-back surface 354 is spaced on the surface of the push-back block 222 without contacting the surface of the push-back block 222.

As shown in the figure, when the lever 30 touches the cover 12 of the housing 10 and stops swinging with respect to the housing 10, the lever 30 stops moving longitudinally in a straight line with respect to the housing 10, and the action of the lever 30, and the actuating cam 33 of the lever 30 contacts the contact block 221 and changes from the initial positioning surface 331*d* to the activation surface 331*b* so that the fixed surface 331*e* of the actuating cam 33 also contacts the flexible section, thereby making the lever 30 to stay in an actuate position P2 where the leaf spring 21 is deformed, and further making the flexible section 212*c* remain in the in the deformed state A2. At the same time, the flexible section 212*c* will be close to the connecting section 212*a* so that the flexible section 212*c* will remain away from the conductive member 22. In this embodiment, when the lever 30 is in the actuate position P2, the first push-back surface 331*a* of the actuating profile 331 is in continuous contact with the push-back block 222 of the conductor 20, and the second push-back surface 331*c* (shown in FIG. 6), the initial positioning surface 331*d*, and the top support surface 331*f* of the actuating profile 331 are not in contact with the conductor 20.

Figure 10:
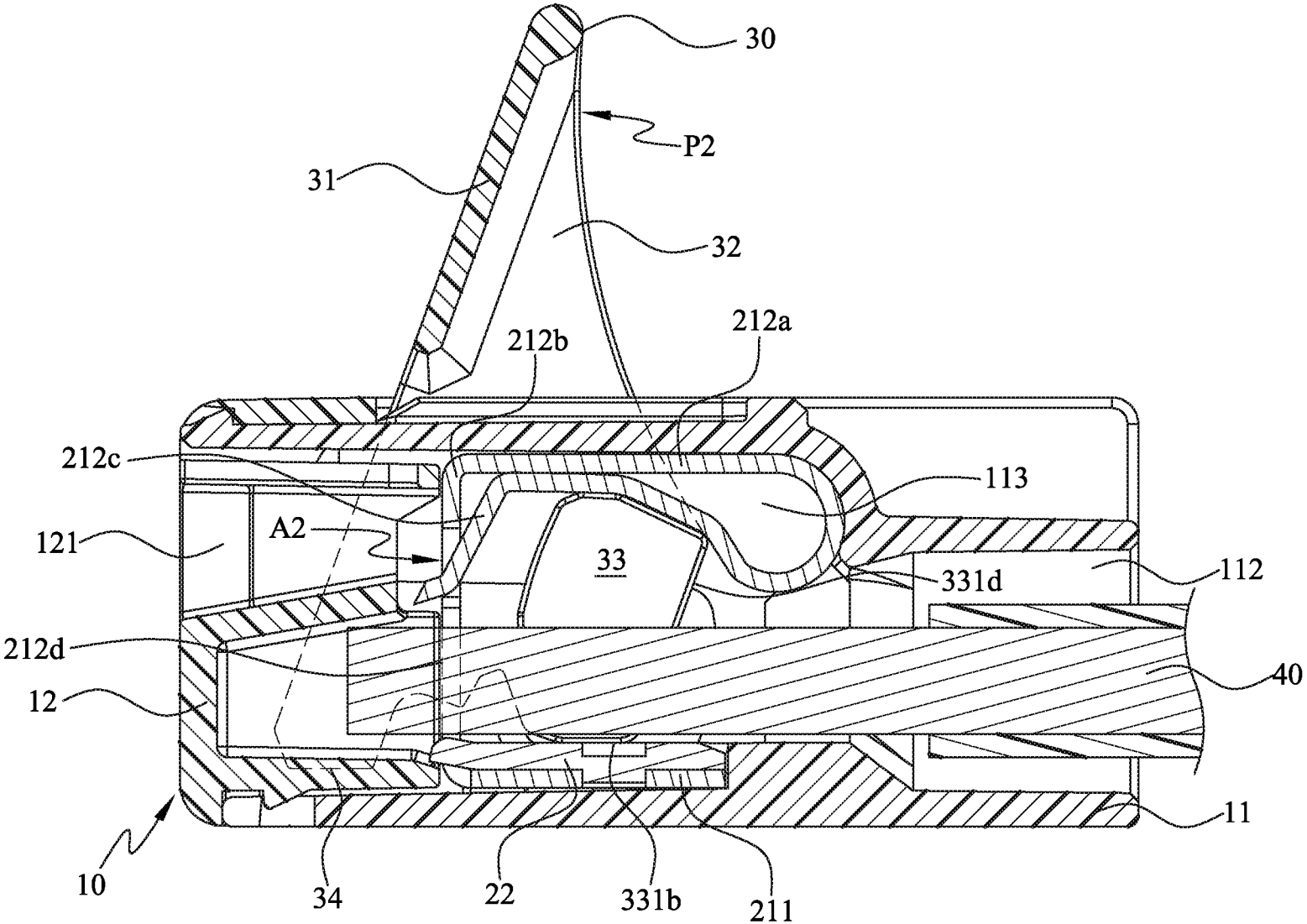
FIG. 10 shows a schematic view of the wire connection device into which a wire is threaded.
Figure 11:
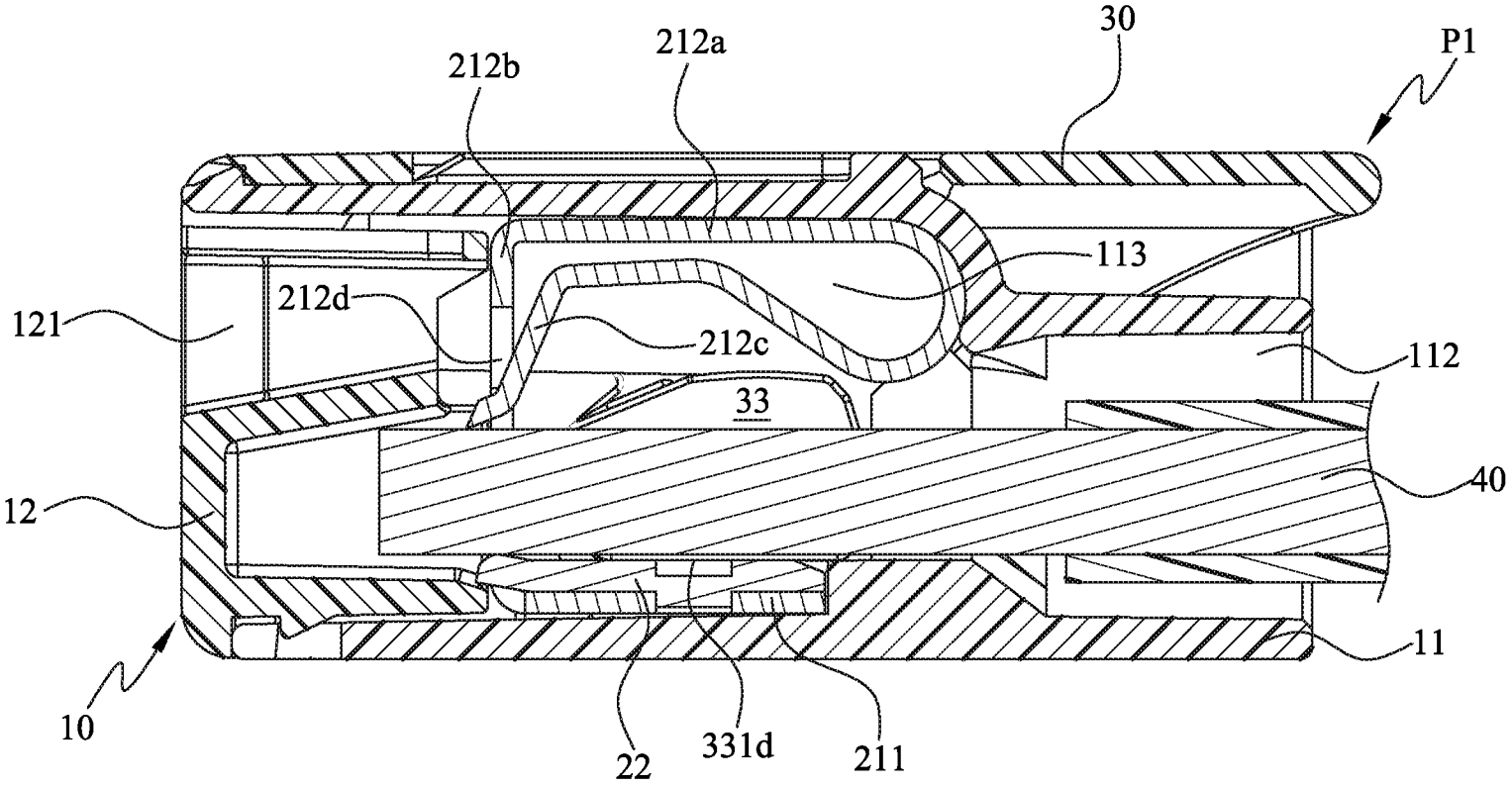
FIG. 11 shows a schematic view of a leaf spring and a conductive member that are clamped together into a wire.

With reference to FIG. 10 and FIG. 11, after the lever 30 is in the actuate position P2, the two wires 40 are threaded through the insertion hole 112 of the housing 10 to the inside of the accommodation space 113 of the housing 10. After passing through the flexible section 212*c* of the leaf spring 21 and the guiding block 223 of the conductive member, the wires 40 may pass through the window 212*d* of the leaf spring 21, thereby allowing the ends of the wires 40 to be placed close to the cover 12 of the housing 10. Next, the lever 30 is moved back from the actuate position P2 to the initial position P1 so that the actuating cam 33 of the lever 30 is not in contact with the flexible section 212*c* of the leaf spring 21. Subsequently, the flexible section 212*c* changes from the deformed state A2 to the initial state A1 so that the flexible section 212*c* may carry the wire 40 close to the contact portion of the conductive member 22, and then the leaf spring 21 can press the wire 40 against the conductive member 22, resulting in the fact that both the leaf spring 21 and the conductive member 22 can be clamped together onto the wire 40. In this way, the two wires 40 may electrically conduct each other through the conductive member 22.

Figure 12:
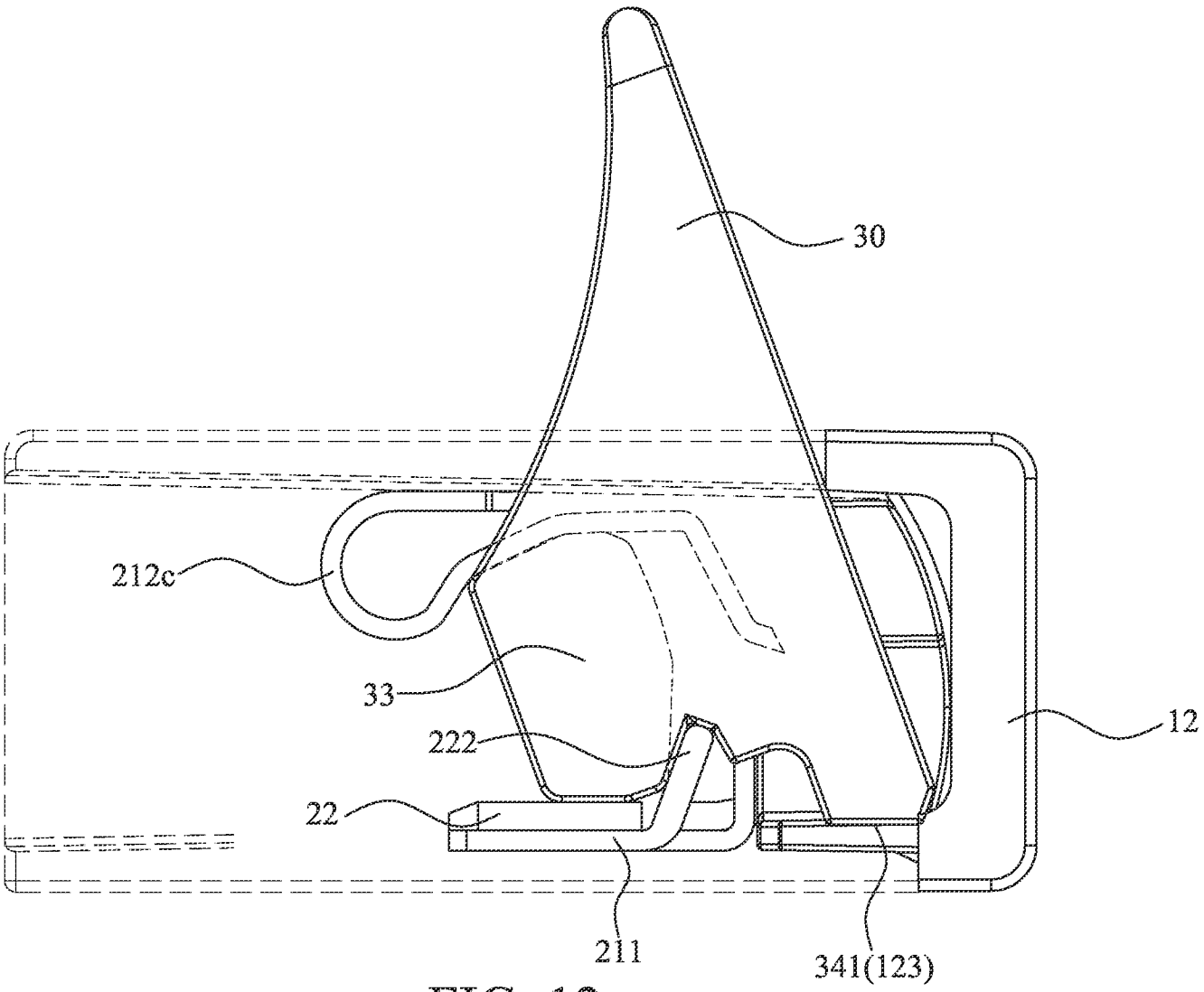
FIG. 12 shows a schematic view of the wire connection device of the invention in a second preferred embodiment.

With reference to FIG. 12, in a second preferred embodiment, the difference from the first preferred embodiment is that the push-back block 222 of the conductive member 22 is formed from the carrier plate 211 of the leaf spring 21 towards the connecting section 212*a* of the leaf spring 21, while both the housing 10 and the lever 30 have the same structural form as the wire connection device 1 of the first preferred embodiment. Furthermore, in this embodiment, the wire connection device 1 is used in the same manner as in the first preferred embodiment and will not be further described in this embodiment.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wire connection device, comprising:

a housing, comprises a plural of insertion holes and a accommodating space that is formed inside the housing for communicating with the insertion holes, so that a plurality of wires penetrate into the accommodating space through the insertion holes;

a conductor, being located inside the accommodation space and having a leaf spring capable of deformation and a conductive member capable of conducting a plurality of wires to each other, the leaf spring has a carrier portion connected to the conductive member and a wire clamping portion formed by extending from the carrier portion, one of the conductive member and the carrier portion extends to form a push-back block, the wire clamping portion is capable of pressing the wires against the conductive member; and a plurality of levers being movably assembled in the housing, and a push-back notch that matches the push-back block and an actuating cam that is accessible to the conductor are formed on the lever inside the housing, the lever swings from an initial position to an actuate position, and the position of a actuating cam surface that contacts the surface of the conductor will be changed so that the lever moves relatively with the housing at the same time;

wherein when the lever is positioned in the actuate position, the wire clamping portion is deformed through the squeezing by the lever, and the push-back block is inserted into the push-back notch.

2. The wire connection device as claimed in claim 1, wherein one side of the wire clamping portion is provided with a plurality of windows for the wires to pass through and the other side of the wire clamping portion is provided with a plurality of flexible sections that one to one aligned the windows, the flexible section, the window, and the insertion hole are aligned each other to form a first straight line, and the push-back block is positioned between two of the flexible sections so that the push-back block and two of the flexible sections are aligned to form a second straight line perpendicular to the first straight line.

3. The wire connection device as claimed in claim 1, wherein the lever comprises a connecting arm that is provided with the push-back notch and the actuating cam, and a toggle plate formed on the connecting arm, the connecting arm is provided with a stopper, the stopper is provided with a stopping surface on the side away from the connecting arm, and the stopping surface contacts the housing when the lever is moved to the actuate position.

4. The wire connection device as claimed in claim 3, wherein the stopping surface is positioned on the side of the push-back notch away from the actuating cam so that the push-back notch is located between the stopping surface and the actuating cam.

5. The wire connection device as claimed in claim 3, wherein a guiding surface away from the insertion hole and a push-back surface adjacent to the guiding surface are formed in the interior of the housing, the stopper is further provided with the push-back surface adjacent to the stopping surface, the push-back surface is in contact with the guiding surface, and the stopping surface is in contact with the push-back surface.

6. The wire connection device as claimed in claim 1, wherein at least two surfaces of the push-back notch are in contact with the push-back block at the same time when the push-back block is inserted into the interior of the push-back notch.

7. The wire connection device as claimed in claim 6, wherein the push-back notch has a first push-back surface close to the actuating cam and a second push-back surface away from the actuating cam, a push-back end surface is formed between the first push-back surface and the second push-back surface, and both the first push-back surface and the push-back end surface are in contact with different sides of the push-back block when the push-back block is located inside the push-back notch.

8. The wire connection device as claimed in claim 7, wherein a separating distance is formed between the first push-back surface and the second push-back surface, the length of the separating distance is greater than the thickness of the push-back block, and further the second push-back surface is separated from the push-back block when both of the first push-back surface and the snap end surface are in contact with different sides of the push-back block.

9. The wire connection device as claimed in claim 7, wherein the push-back notch is provided with a push-back opening away from the push-back end surface, and the second push-back surface will gradually approach the first push-back surface from the push-back opening toward the push-back end surface so that the second push-back surface is tilted to the first push-back surface, and further the push-back notch gradually tapers off from the snap opening toward the snap end surface.

10. The wire connection device as claimed in claim 1, wherein the actuating cam is provided with an activation surface close to the push-back notch and a fixed surface away from the activation surface in different localized areas, the activation surface and the fixed surface are located on opposite sides of the actuating cam, and the lever stays in the activation position when both the activation surface and the fixed surface are in contact with the conductor.

11. The wire connection device as claimed in claim 10, wherein the lever swings from the actuate position to the initial position, the lever is not pressed against the leaf spring so that the activation surface is facing the push-back block so as the push-back block to be positioned outside of the push-back notch, and the fixed surface is separated from the conductor.

12. The wire connection device as claimed in claim 11, wherein the actuating cam further has an initial positioning surface between the activation surface and the fixed surface and the initial positioning surface contacts the conductor to allow the lever to hold in the initial position.

13. The wire connection device as claimed in claim 12, wherein the actuating cam further has a first push-back surface adjacent to one side of the initial positioning surface, the first push-back surface is close to the push-back notch, and in the process of moving the lever to the actuate position, the first push-back surface pushes against the push-back block, causing the push-back block to be deformed.

14. The wire connection device as claimed in claim 13, wherein the initial positioning surface has a second push-back surface adjacent to the activation surface on a side distant from the first push-back surface, the second push-back surface is in contact with the conductor when the first push-back surface is pushed against the push-back block, and the activation surface and the initial positioning surface are separated from the conductor.

* * * * *